US008097186B2

(12) United States Patent
Hoidis et al.

(10) Patent No.: US 8,097,186 B2
(45) Date of Patent: Jan. 17, 2012

(54) MICROVARISTOR-BASED OVERVOLTAGE PROTECTION

(75) Inventors: Markus Hoidis, Fislisbach (CH); Lise Donzel, Wettingen (CH)

(73) Assignee: ABB Research Ltd, Zurich (CH)

( * ) Notice: Subject to any disclaimer, the term of this patent is extended or adjusted under 35 U.S.C. 154(b) by 205 days.

(21) Appl. No.: 12/417,741

(22) Filed: Apr. 3, 2009

(65) Prior Publication Data

US 2009/0200521 A1 Aug. 13, 2009

Related U.S. Application Data

(63) Continuation of application No. PCT/CH2006/000551, filed on Oct. 6, 2006.

(51) Int. Cl.

| | |
|---|---|
| ***H01B 1/02*** | (2006.01) |
| ***H01B 1/22*** | (2006.01) |
| ***H01B 1/08*** | (2006.01) |
| ***H01C 7/10*** | (2006.01) |

(52) U.S. Cl. ..... 252/518.1; 252/512; 252/514; 338/20

(58) Field of Classification Search ..... 252/519.5, 252/518.1, 512, 514; 338/20, 21

See application file for complete search history.

(56) References Cited

U.S. PATENT DOCUMENTS

| | | | | |
|---|---|---|---|---|
| 2,887,632 | A * | 5/1959 | Dalton | 257/43 |
| 4,311,729 | A * | 1/1982 | Itakura et al. | 427/80 |
| 4,959,262 | A * | 9/1990 | Charles et al. | 428/329 |
| 5,068,634 | A | 11/1991 | Shrier | |
| 5,669,381 | A | 9/1997 | Hyatt | |
| 6,251,513 | B1 | 6/2001 | Rector et al. | |
| 6,334,964 | B1 * | 1/2002 | Cowman et al. | 252/500 |
| 6,469,611 | B1 * | 10/2002 | Kluge-Weiss et al. | 338/20 |
| 2002/0130301 | A1 | 9/2002 | Chun-Yuan | |
| 2005/0218380 | A1 | 10/2005 | Gramespacher et al. | |

FOREIGN PATENT DOCUMENTS

| | | | |
|---|---|---|---|
| DE | 19821239 | A1 | 11/1999 |
| DE | 19919652 | A1 | 11/2000 |
| EP | 0992042 | B1 | 8/2005 |
| EP | 1585146 | A1 | 10/2005 |

OTHER PUBLICATIONS

PCT/ISA/210 of PCT/CH2006-000551 completed May 21, 2007.
PCT/ISA/237 of PCT/CH2006-000551 completed May 21, 2007.
F. Greuter et al.; Microvaristors: Functional Fillers for Novel Electroceramic Composites; Journal of Electroceramics; 2004; pp. 739-744; vol. 13; Kluwer Academic Publishers; The Netherlands.

* cited by examiner

*Primary Examiner* — Mark Kopec
*Assistant Examiner* — Jaison Thomas
(74) *Attorney, Agent, or Firm* — Buchanan Ingersoll & Rooney PC

(57) ABSTRACT

A method is disclosed for producing a non-linear powder having microvaristor particles which have a non-linear current-voltage characteristic. The production steps includes mixing non-metallic particles with the microvaristor particles, thermally treating the non-metallic particles for decomposing them into electrically conductive particles and fusing the electrically conductive particles onto the microvaristor particles. Embodiments, among other things, relate to: breaking up agglomerates of the non-metallic particles during mixing; keeping the decomposition temperature below a sintering or calcination temperature of the microvaristor particles; and choosing micron-sized or nano-sized non-conductive particles for microvaristor decoration. The production method produces varistor powder with improved reproducibility of the non-linear electric current-voltage characterstic and with reduced switching fields ($E_s$).

16 Claims, 1 Drawing Sheet

MICROVARISTOR-BASED OVERVOLTAGE PROTECTION

RELATED APPLICATIONS

This application claims priority as a continuation application under 35 U.S.C. §120 to PCT/CH2006/000551 filed as an International Application on Oct. 6, 2006 designating the U.S., the entire content of which is hereby incorporated by reference in its entirety.

TECHNICAL FIELD

The disclosure relates to the field of overvoltage protection in electric and/or electronic circuitry, such as protection against lightning, electromagnetic pulses, switching surges or ground loop transients or electrostatic discharge (ESD) protection. The disclosure relates, in particular, to nonlinear electrical materials and devices for such purposes. The disclosure is based on the method for producing a non-linear powder, a compound comprising such a powder and an over-voltage or field control device comprising such a powder.

BACKGROUND INFORMATION

Microvaristor filled polymers show non-linear current-voltage characteristics and can be used for over-voltage protection purposes, for example to protect sensitive electronics from electrostatic discharges. Nonlinear materials composed of a polymer matrix filled with conductive and/or semi-conductive and/or insulating particles are known and used for over-stress protection of electronic chips. The protection voltage level needed for electronics is low, which means that the material should have either a low clamping or switching voltage or should be very thin.

EP 0 992 042 (WO 99/56290) discloses varistor composites comprising microvaristor filler particles embedded in a matrix and a production method for such varistor composites. The non-linear filler material comprises sintered microvaristor granulate made of doped zinc oxide. The switching voltage of the composite can be reduced by decorating the microvaristor particles with micro-sized metallic flakes. In the decoration process, in a first step the microvaristor particles and the metallic flakes are intimately mixed, and in a second step the flakes are bonded to the microvaristor particles by heat treatment. This process suffers from the fact that micrometer metal particles tend to agglomerate. Breaking of the agglomerates in a dry mill is not possible, because the metal is ductile. Instead, the agglomerates tend to solidify by cold welding. Therefore the quality of the decoration strongly depends on the handling of the metallic powder, leading to non-reproducible non-linear properties of the compounds.

In the article by F. Greuter et al., "Microvaristors: Functional Fillers for Novel Electroceramic Composites", J. Electroceramics, 13, 739-744 (2004), varistor composites containing ZnO microvaristors embedded in a polymer matrix are disclosed for electrostratic discharge (ESD) protection of electronics. The ZnO microvaristor particles show strong nonlinearities of their electrical resistance as a function of the applied electric field. The nonlinear behaviour of the composite material depends on the microvaristor particle nonlinearities, their packing arrangement and the microscopic properties of the particle-particle contacts. By decorating the microvaristors with small metal flakes, the switching field of the composite is reduced and the energy absorption is improved. The conventional decoration process using metallic flakes suffers from the agglomeration problems as discussed above. For applications in ESD protection, polymers filled with decorated microvaristor particles can be molded, casted, etc. onto the electronic elements to be protected.

SUMMARY

A method for producing a non-linear electrical powder is disclosed and a varistor powder and varistor device are disclosed with improved nonlinear electrical properties.

A method for producing a non-linear powder is disclosed comprising decorated microvaristor particles which have a non-linear current-voltage characteristic, characterised by the subsequent production steps of a) mixing non-metallic particles with the microvaristor particles, b) in the mixed state, thermally treating the mixture for decomposing the non-metallic particles into electrically conductive particles and for bonding the electrically conductive particles onto the microvaristor particles.

Further exemplary embodiments, advantages and applications of the disclosure will become apparent from consideration of the following detailed description and the figures.

BRIEF DESCRIPTION OF THE DRAWING

The subject matter of the disclosure will be explained in more detail in the following text with reference to exemplary embodiments and a graph illustrated in the attached drawing, in which.

DETAILED DESCRIPTION

Figure 1:
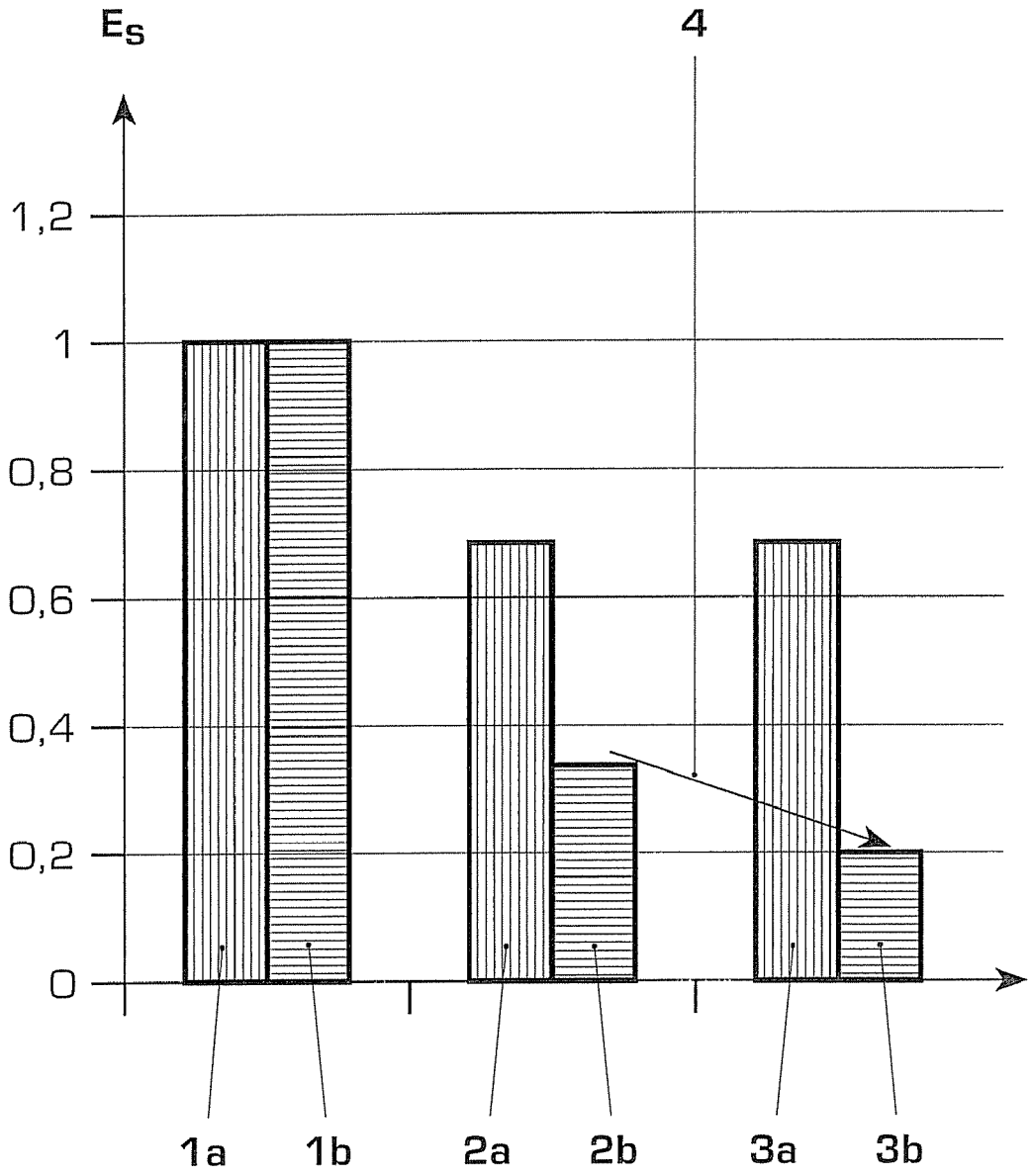
FIG. 1 illustrates an exemplary graph showing relative switching field strengths for powders produced according to exemplary embodiments of the disclosure.

In a first aspect, a method is disclosed for producing a non-linear powder comprising decorated microvaristor particles which have a non-linear current-voltage characteristic, comprising the subsequent production steps of (i) mixing non-metallic particles with the microvaristor particles, and (ii) in the mixed state, thermally treating the mixture for decomposing the non-metallic particles into electrically conductive particles and for bonding or fusing the electrically conductive particles onto the microvaristor particles. Thus, the disclosure consists in mixing non-metallic or non-conductive particles among the microvaristors, wherein these non-conductive particles can decompose into or separate into conductive or metallic particles, wherein further these non-conductive particles do not agglomerate or, if agglomerated, are breakable, in contrast to metallic particles that tend to agglomerate and cold-weld during mixing. Therefore, the novel decoration method of microvaristors with metal particles is achieved with unprecedented homogeneity and reproducibility. As a result, a varistor powder with specified non-linear current-voltage characteristic can be produced with very much improved reliability. Overall, improved non-linear electrical properties are achieved, in particular reduced electric switching fields of the varistor which is favorable for electrostatic discharge protection.

In further aspects, the disclosure relates to a compound and to an over-voltage or field control device comprising the powder produced as shown above.

In an exemplary embodiment, non-conductive nano-particles are admixed to the microvaristors and, when distributed homogeneously, are decomposed into conductive particles and are bonded or fused onto the microvaristor surfaces. Nano-particles are advantageous in that they achieve even further reduction of switching fields and in that the switching fields can be fine-tuned and, in particular, minimized by increasing the mixing energy.

The disclosure relates to a method for producing a non-linear powder comprising microvaristor particles which have a non-linear current-voltage behavior. In order to reduce the switching field strength, the microvaristor particles are decorated using the subsequent steps of (i) mixing non-metallic particles with the microvaristor particles, and (ii) in the mixed state, thermally treating the mixture for decomposing the non-metallic particles into electrically conductive particles and bonding or fusing the electrically conductive particles onto the microvaristor particles.

The term non-metallic or non-conductive particle here refers to particles that do not consist of or comprise pure metal, which shows metal-typical agglomerating or cold-welding behavior during the mixing process. This term of non-metallic or non-conductive particles in the sense of this application shall, furthermore, relate to particles that can decompose or separate into a particle, e.g. upon heat treatment, that is a metal or shows metallic or electrically conductive behavior. In the following, exemplary embodiments are discussed.

The novel decoration process, which comprises mixing and heat treatment-induced decomposition (i.e. transformation of non-metallic into conductive particles) and bonding (i.e. fusing the obtained conductive particles onto the microvaristors) is effected such that the surface of the microvaristor particles shall be covered only partially with the electrically conductive particles.

In an exemplary embodiment the idea is to mix silver oxide particles (AgO or $Ag_2O$) instead of silver to the microvaristor filler. Even if the silver oxide micro-sized or nano-sized particles agglomerate, these agglomerates, however, can successfully be broken up owing to their different behaviour compared to ductile metals. Breaking up can be achieved, for example, by mixing the silver oxide powder with the microvaristors in a mill with milling balls, e.g. in a roll mill with $ZrO_2$ milling balls. Conventional metal particles, in contrast, tend to further agglomerate and even cold-weld together in an uncontrollable manner. After mixing the mixture is heat treated to reduce the silver oxide particles into silver. At the same time bonding of the particles to the microvaristor surface is achieved.

Therefore, the process of admixing silver oxide particles and, in the mixed state, producing metallic silver particles out of them and bonding them onto the microvaristors insures a homogeneous repartition of the decoration particles among the microvaristor particles.

Experiments showed that a 3 hour heat treatment at 400° C. is adequate to produce varistor powder with low switching fields. The varistor powder decorated according to disclosure has been visually inspected by using photography and EDX-mapping. The homogeneity of the mixture was found to be excellent. In conclusion, the mixing process shall be performed until homogeneous repartition of the non-metallic particles among the microvaristor particles is achieved. During mixing agglomerates of the non-metallic particles can be broken up, in particular by using a mill with milling balls. The decomposition temperature is preferably chosen lower than a sintering or calcination temperature of the powder. Decomposition temperatures for decomposing the non-metallic particles lower than 700° C., preferred lower than 500° C., most preferred around 400° C., are recommended.

The non-metallic particles can comprise or consist of metal oxides, metal nitrides, metal sulphides, and/or metal halogenides. For example, the non-metallic particles comprise or consist in gold oxide, platinum oxide, and/or silver oxide. A preferable choice for the non-metallic particles are silver compounds, such as $AgNO_2$, $Ag_2F$, AgO, or $Ag_2O$.

FIG. 1 shows the effect of admixtured particle size and mixing energy, i.e. mixing speed and size of milling balls, on the resulting switching field $E_s$ of the varistor powder. It was discovered that mixtures 1*b*, 2*b*, 3*b* with nano-sized silver oxide particles ($Ag_2O$ particles with typical dimension smaller than 1 μm) behave differently than mixtures 1*a*, 2*a*, 3*a* with micron-sized silver oxide particles ($Ag_2O$ particles with typical dimensions in the range of 1 μm-3 μm, or eventually larger).

While essentially no effect of the mixing energy is observed on the obtained switching field for micron-sized $Ag_2O$ (2*a*, 3*a* in FIG. 1), a strong effect was observed for nano-sized $Ag_2O$ (2*b*, 3*b* in FIG. 1). Moreover for the same amount of $Ag_2O$ the reduction in switching field is much larger for admixture of the nano-$Ag_2O$ powder.

Consequently, by decorating the micorvaristors with nano-sized non-metallic particles a very efficient and pronounced reduction of the switching field $E_s$ can be obtained. This allows to make over-stress protection devices with small dimensions and very low protective switching fields $E_s$ or, correspondingly, very low protection voltage levels.

Therefore, in one embodiment using micron-sized non-metallic or non-conductive particles, these particles shall have a typical dimension smaller than 5 μm, preferred smaller than 3 μm, more preferred smaller than 1 μm. In exemplary embodiments with nano-sized non-metallic or non-conductive particles, these particles shall have a typical dimension smaller than 300 nm.

The amount of the non-metallic particles in relation to the amount of the microvaristor particles is preferably chosen in a range between 0.01 vol % to 5 vol %. The example given in FIG. 1 refers to samples containing 0.5 vol % $Ag_2O$ and 99.5 vol % of microvaristor particles.

Finally, the disclosure pertains also to a compound having non-linear electrical properties and comprising the powder produced as described above and being embedded in a matrix, e.g. a polymer matrix, glass matrix or oil matrix. An over-voltage or field control device comprising such a powder shall be protected, as well. The device can be a surge arrester or an electrostatic discharge protection means.

It will be appreciated by those skilled in the art that the present disclosure can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

1*a*, 1*b* microvaristor powder only (as reference)

2*a* powder with less energetic mixing and macro-sized decorating particles

2*b* powder with less energetic mixing and nano-sized decorating particles

3*a* powder with more energetic mixing and macro-sized decorating particles

3*b* powder with more energetic mixing and nano-sized decorating particles

4 reduction of switching field $E_s$ electric switching field (of varistor).

What is claimed is:

1. A method for producing a non-linear powder having microvaristor particles which have a non-linear current-voltage characteristic, the method comprising:

a) mixing non-metallic particles with the microvaristor particles to form a mixture; and b) in a mixed state, thermally treating the mixture for decomposing the non-metallic particles into electrically conductive particles and for bonding the electrically conductive particles onto the microvaristor particles.

2. The method as claimed in claim 1, comprising:

decorating the microvaristor particles by mixing, decomposition and bonding such that surfaces of the microvaristor particles are covered only partially with the electrically conductive particles.

3. The method as claimed in claim 2, wherein a) the mixing is performed until homogeneous repartition of the non-metallic particles among the microvaristor particles is achieved; and/or b) during mixing, agglomerates of the non-metallic particles are broken up.

4. The method as claimed in claim 1, wherein a) the mixing is performed until homogeneous repartition of the non-metallic particles among the microvaristor particles is achieved; and/or b) during mixing, agglomerates of the non-metallic particles are broken up.

5. The method as claimed in claim 4, wherein a) a temperature for the decomposing is lower than a sintering or calcination temperature of the powder; and/or b) a temperature for the decomposing of the non-metallic particles is lower than 700° C.

6. The method as claimed in claim 1, wherein a) a temperature for the decomposing is lower than a sintering or calcination temperature of the powder; and/or b) a temperature for the decomposing of the non-metallic particles is lower than 700° C.

7. The method as claimed in claim 6, wherein a) the non-metallic particles comprise metal oxides, metal nitrides, metal sulphides, and/or metal halogenides; and/or b) the non-metallic particles comprise gold oxide, platinum oxide, and/or silver oxide; and/or c) the non-metallic particles comprise a silver compound.

8. The method as claimed in claim 1, wherein a) the non-metallic particles comprise metal oxides, metal nitrides, metal sulphides, and/or metal halogenides; and/or b) the non-metallic particles comprise gold oxide, platinum oxide, and/or silver oxide; and/or c) the non-metallic particles comprise a silver compound.

9. The method as claimed in claim 8, wherein the non-metallic particles consist of silver oxide which is heat-treated for 3 hours at 400° C.

10. The method as claimed in claim 1, wherein the non-metallic particles consist of silver oxide which is heat-treated for 3 hours at 400° C.

11. The method as claimed in claim 10, wherein the non-metallic particles have a dimension smaller than 3 μm.

12. The method as claimed in claim 1, wherein the non-metallic particles have a dimension smaller than 5 μm.

13. The method as claimed in claim 12, wherein the non-metallic particles are nano-particles with a dimension smaller than 300 nm.

14. The method as claimed in claim 1, wherein the non-metallic particles are nano-particles with a dimension smaller than 300 nm.

15. The method as claimed in claim 14, wherein an amount of the non-metallic particles in relation to the amount of the microvaristor particles is about 0.01 vol % to 5 vol %.

16. The method as claimed in claim 1, wherein an amount of the non-metallic particles in relation to an amount of the microvaristor particles is about 0.01 vol % to 5 vol %.

* * * * *